US005085199A

United States Patent [19]

Sado et al.

[11] Patent Number: 5,085,199

[45] Date of Patent: Feb. 4, 1992

[54] V-TYPE ENGINE EQUIPPED WITH A SUPERCHARGING DEVICE

[75] Inventors: Osamu Sado, Higashihiroshima; Shunji Masuda, Hiroshima, both of Japan

[73] Assignee: Mazda Motor Corporation, Hiroshima, Japan

[21] Appl. No.: 470,741

[22] Filed: Jan. 26, 1990

[30] Foreign Application Priority Data

Jan. 31, 1989 [JP] Japan ..... 1-22366

[51] Int. Cl.[5] ..... F02B 33/00; F02B 53/00

[52] U.S. Cl. ..... 123/559.1; 123/198 R

[58] Field of Search ..... 123/559.1, 198 R, 146.5 A, 123/90.27

[56] References Cited

U.S. PATENT DOCUMENTS

| | | | |
|---|---|---|---|
| 4,028,892 | 6/1977 | Hinkle . | |
| 4,615,308 | 10/1986 | Asanomi et al. | 123/198 C |
| 4,723,526 | 2/1988 | Horiuchi et al. | 123/559.1 |
| 4,932,368 | 6/1990 | Abe et al. | 123/559.1 |
| 4,951,616 | 8/1990 | Aruga et al. | 123/198 R |

FOREIGN PATENT DOCUMENTS 61-1624 6/1984 Japan .

*Primary Examiner*—Richard A. Bertsch
*Assistant Examiner*—Alfred Baskhas
*Attorney, Agent, or Firm*—Sixbey, Friedman, Leedom & Ferguson

[57] ABSTRACT

A V-type engine equipped with a supercharging device, which comprises an engine body having first and second cylinder banks formed in the V-shape and a crank shaft disposed therein, a pair of camshafts disposed in the first and second cylinder banks, respectively, an endless belt engaged with each of one end portions of the camshafts and one end portion of the crank shaft in such a manner that the first cylinder bank is disposed on the tension side of the endless belt, and an engine-driven supercharger mounted on the engine body to jut out widthwise from the first cylinder bank and driven to rotate by the crank shaft through an additional endless belt engaged with the engine-driven supercharger and the one end portion of the crank shaft.

9 Claims, 2 Drawing Sheets

V-TYPE ENGINE EQUIPPED WITH A SUPERCHARGING DEVICE

BACKGROUND OF THE INVENTION

1. Field of the Invention

The present invention relates generally to a V-type engine equipped with a supercharging device, and more particularly, to an engine having an engine body formed to have a couple of V-shaped cylinder banks and an engine-driven supercharger driven to rotate by a crank shaft disposed in the engine body through an endless belt engaged with both of the engine-driven supercharger and the crank shaft.

2. Description of the Prior Art

There has been proposed a V-type engine equipped with an engine-driven supercharger, in which a camshaft is disposed in common for driving inlet valves and exhaust valves in each of a couple of cylinder banks formed in the V-shape as parts of an engine body and the engine-driven supercharger is disposed on the engine body between the cylinder banks to be driven by a crank shaft disposed in the engine body through an endless belt engaged with both of the engine-driven supercharger and the crank shaft, as disclosed in the Japanese utility model application published before examination under publication number 61-1624. In the case where the V-type engine thus constituted is provided with a distributor driven to rotate directly by the camshaft, it is desired that the distributor is mounted on the cylinder bank disposed on the tension side of an endless belt which is engaged with both of one end portion of the camshaft provided therein and one end portion of the crank shaft for rotating the camshaft because the distributor is required to rotate in exact synchronism with revolutions of the crank shaft.

In the event of such a V-type engine as described above, it is feared that antiknock property is degraded due to intake air compressed by the engine-driven supercharger and therefore a compression ratio in each of cylinders in the cylinder bank may be set to be relatively low for avoiding the degradation of antiknock property. However, the low compression ratio in the cylinder results in a disadvantage that thermal efficiency in the cylinder is reduced so as to bring about deterioration in fuel consumption.

In view of this, with the intention of suppressing knocking in the cylinder without being attended with the disadvantage mentioned above, it has been proposed to provide a valve timing control mechanism for changing the opening timing of each of the inlet or exhaust valves and cause the same to so operate that an overlapping duration in which both the inlet and exhaust valves are kept open is made longer in accordance with increase of engine speed. If the V-type engine is of the double overhead camshaft (DOHC) type with a pair of camshafts provided in each of cylinder banks formed in the V-shape for driving respectively inlet valves and exhaust valves in the cylinder bank, the valve timing control mechanism is constituted in the form of a device for varying the relative phase of the revolution of the camshaft for driving the inlet or exhaust valves in relation to the revolution of a pulley mounted on the same camshaft to engage with an endless belt from a crank shaft. With such a valve timing control mechanism, although it is possible to make the overlapping duration longer by advancing a time point at which the inlet valve is opened in accordance with increase of engine speed or by retarding a time point at which the exhaust valve is closed, it is desired that the valve timing control mechanism is attached to the camshaft for driving the exhaust valves so that the time point at which the exhaust valve is closed is retarded to make the overlapping duration longer for the reason that the operation of the engine is kept stable even in a condition of light load, such as an idling condition.

From the above point of view, in the case of the DOHC V-type engine equipped with the engine-driven supercharger, it is desired that both the distributor and the valve timing control mechanism are provided in the cylinder bank which is disposed on the tension side of the endless belt engaged with each of the camshafts and the crank shaft and according to this desire the distributor and the valve timing control mechanism are mounted respectively on one end portion of the camshaft for driving the inlet valves and one end portion of the camshaft for driving the exhaust valves provided in the cylinder bank which is disposed on the tension side of the endless belt engaged with each of the camshafts and the crank shaft.

In the case where the DOHC V-type engine equipped with the engine-driven supercharger, which is provided with the distributor and the valve timing control mechanism mounted respectively on one end portion of the camshaft for driving the inlet valves and one end portion of the camshaft for driving the exhaust valves provided in the cylinder bank which is disposed on the tension side of the endless belt engaged with each of the camshafts and the crank shaft as described above, is transversely mounted on a vehicle in such a manner that the crank shaft disposed in the engine body extends along the direction of the width of the vehicle, if the engine-driven supercharger is disposed on the engine body between the cylinder banks formed in the V-shape or on the right or left side of the engine body, the engine-driven supercharger projects in a relatively large way from the upper end or the right or left end of the engine body and therefore an engine room of the vehicle, in which the DOHC V-type engine equipped with the engine-driven supercharger is contained, is caused to be insufficient in space around the engine body. Accordingly, for restricting the engine-driven supercharger from projecting in a relatively large way from the engine body, it is considered that the engine-driven supercharger is mounted on the engine body to jut out backward or forward, namely, widthwise from one of the cylinder banks. However, if the engine-driven supercharger is mounted on the engine body to jut out widthwise from the cylinder bank which is disposed on the slack side of the endless belt engaged with each of the camshafts in the same cylinder bank and the crank shaft, the engine body is apt to lean undesirably so as to bring down the cylinder bank which is disposed on the slack side of the endless belt engaged with each of the camshafts in the same cylinder bank and the crank shaft and thereby to bring about undesirable rolling in response to the revolutions of the crank shaft when the engine starts operating.

OBJECTS AND SUMMARY OF THE INVENTION

Accordingly, it is an object of the present invention to provide a V-type engine equipped with a supercharging device which avoids the aforementioned disadvantages and problems encountered with the prior art.

Another object of the present invention is to provide a V-type engine equipped with a supercharging device, which is provided with an engine-driven supercharger mounted on an engine body having a couple of cylinder banks formed in the V-shape and a crank shaft disposed therein in such a manner that the size of the engine is reduced in overall height and overall length in the direction along which the crank shaft extends, without bringing about undesirable rolling of the engine body when the engine starts operating.

A further object of the present invention is to provide a V-type engine equipped with a supercharging device, which is provided with an engine-driven supercharger mounted on an engine body thereof having a couple of cylinder banks formed in the V-shape and a crank shaft disposed therein to jut out widthwise from one of the cylinder banks so as to reduce the size of the engine in overall height and overall length in the direction along which the crank shaft extends, without causing the engine body to lean to bring down the cylinder bank from which the engine-driven supercharger juts out when the engine starts operating.

In accordance with the present invention, there is provided a V-type engine equipped with a supercharging device, which comprises an engine body having first and second cylinder banks formed in the V-shape and a crank shaft disposed therein, a pair of camshafts disposed respectively in the first and second cylinder banks, respectively, an endless belt engaged with each of one end portions of the camshafts and one end portion of the crank shaft in such a manner that the first cylinder bank is disposed on the tension side of the endless belt, and an engine-driven supercharger mounted on the engine body to jut out widthwise from the first cylinder bank and driven to rotate by the crank shaft through an additional endless belt engaged with the engine-driven supercharger and the end portion of the crank shaft.

In an embodiment of V-type engine equipped with a supercharging device according to the present invention, a distributor is also mounted on the first cylinder bank to be driven to rotate by the camshaft disposed in the first cylinder bank.

In the V-type engine thus constituted in accordance with the present invention, the engine-driven supercharger is mounted on the engine body to jut out widthwise from the first cylinder bank which is disposed on the tension side of the endless belt engaged with each of one end portions of the camshafts and one end portion of the crank shaft. Therefore, the V-type engine according to the invention is restricted to a relatively small size in each of its overall height and its overall length in the direction along which the crank shaft extends and prevented from bringing about undesirable rolling of the engine body on the occasion of starting in its operation.

Further, in the embodiment, the distributor is mounted on the first cylinder bank which is disposed on the tension side of the endless belt engaged with each of one end portions of the camshafts and one end portion of the crank shaft and therefore driven to rotate in exact synchronism with revolutions of the crank shaft. This results in that ignition timing is accurately determined in the engine body.

The above, and other objects, features and advantages of the present invention will become apparent from the following detailed description which is to be read in conjunction with the accompanying drawings.

DESCRIPTION OF THE PREFERRED EMBODIMENT

Figure 1:
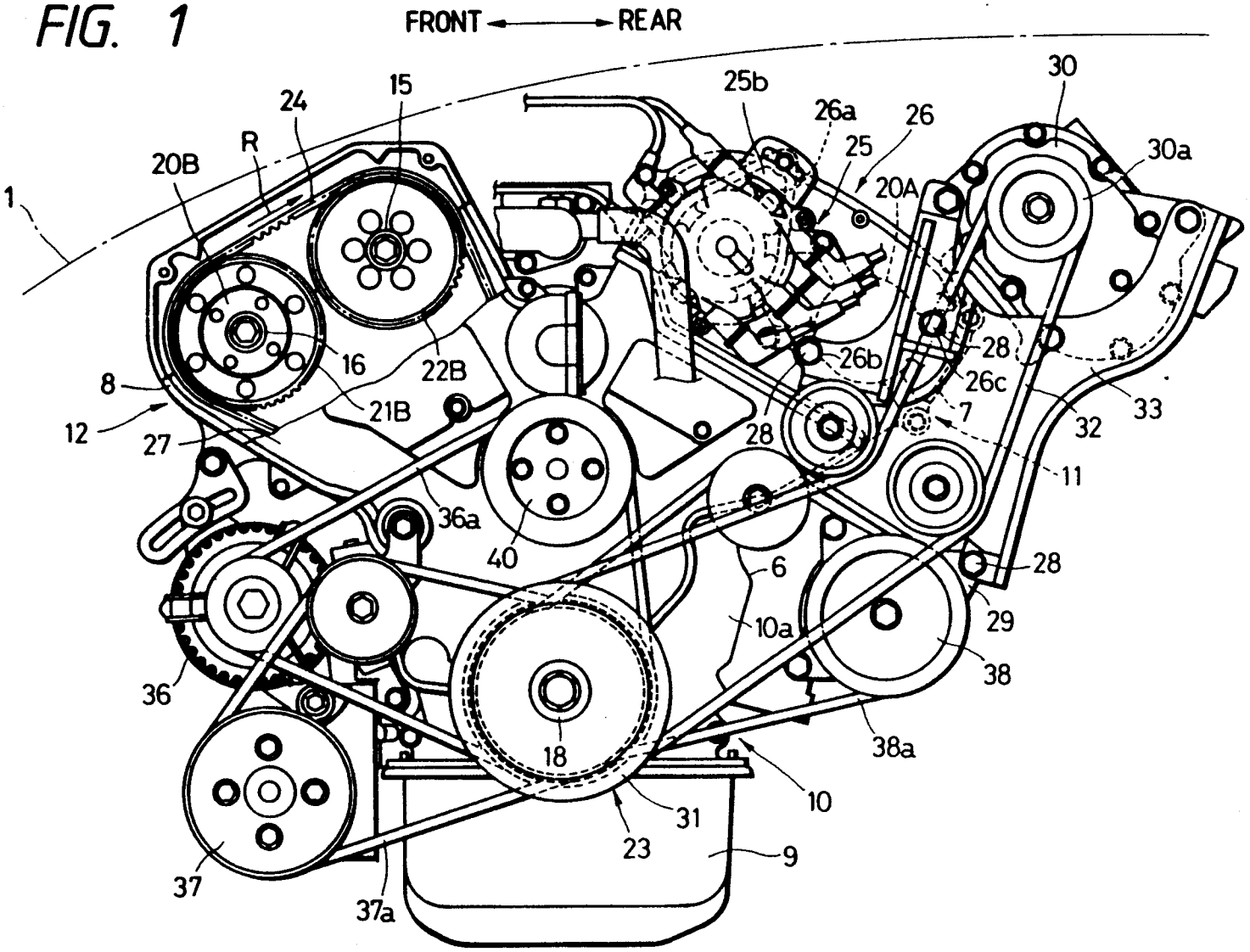
FIG. 1 is a schematic front view showing an embodiment of V-type engine equipped with a supercharging device according to the present invention.

An embodiment of V-type engine equipped with a supercharging device according to the present invention is shown in FIG. 1. The embodiment is formed into a vehicle engine of the DOHC V-type with six cylinders.

Referring to FIG. 1, an engine body 10 which comprises a cylinder block 6, a couple of cylinder heads 7 and 8 disposed on the cylinder block 6, and an oil pan 9 attached to the bottom of the cylinder block 6 is arranged to have first and second cylinder banks 11 and 12 formed in the V-shape and a crank shaft 18 disposed in the cylinder block 6. This engine body 10 is contained in an engine room of a vehicle body under a hood 1 in such a manner that the crank shaft 18 extends in the direction of the width of the vehicle body.

Figure 2:
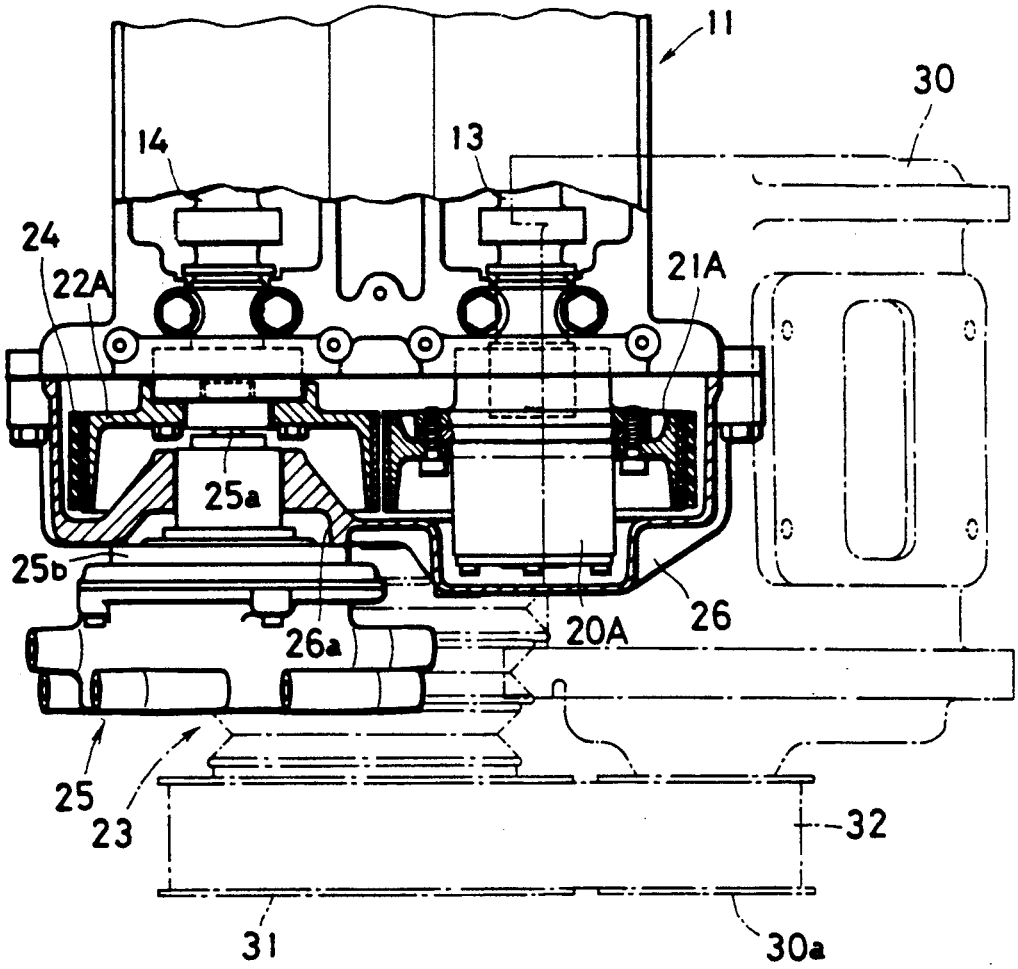
FIG. 2 is a schematic cross-sectional view showing a portion of the embodiment shown in FIG. 1.

The first cylinder bank 11 contains three aligned cylinders and similarly the second cylinder bank 12 contains another three aligned cylinders. In the first cylinder bank 11, as shown in FIG. 2, a camshaft 13 for driving intake valves provided respectively for the cylinders in the first cylinder bank 11 and a camshaft 14 for driving exhaust valves provided respectively for the cylinders in the first cylinder bank 11 are provided to extend in the direction along which the crank shaft 18 extends. The camshaft 13 is laterally positioned to be outer than the camshaft 14 in the engine body 10. Further, in the second cylinder bank 12, a camshaft 15 for driving intake valves provided respectively for the cylinders in the second cylinder bank 12 and a camshaft 16 for driving exhaust valves provided respectively for the cylinders in the second cylinder bank 12 are provided to extend in the direction along which the crank shaft 18 extends. The camshaft 16 is laterally positioned to be outer than the camshaft 15 in the engine body 10.

As shown in FIG. 2, a valve timing controller 20A and a cam pulley 21A surrounding the valve timing controller 20A are mounted on one end portion of the camshaft 13 on the side of a side wall **10*a* of the engine body 10 from which one end portion of the crank shaft 18 projects outward. Similarly, a valve timing controller 20B and a cam pulley 21B surrounding the valve timing controller 20B are mounted on one end portion of the camshaft 16 on the side of the side wall 10*a* of the engine body 10. The valve timing controller 20A is operative to retard the relative phase of the revolution of the camshaft 13 in relation to the revolution of the cam pulley 21A in response to the speed of revolution of the crank shaft 18 (engine speed), and the valve timing controller 20B is operative to retard the relative phase of the revolution of the camshaft 16 in relation to the revolution of the cam pulley 21B in response to the speed of revolution of the crank shaft 18**.

As shown also in FIG. 2, a rotary shaft **25*a* of a distributor 25 and a cam pulley 22A surrounding the rotary shaft 25*a* are mounted on one end portion of the camshaft 14 on the side of the side wall 10***a* of the engine body 10. Further, a cam pulley 22B is mounted on one end portion of the camshaft 15 on the side of the side wall 10*a* of the engine body 10.

A plurality of crank pulleys 23 are mounted on the end portion of the crank shaft 18 projecting outward from the side wall 10*a* of the engine body 10 and a cogged endless belt 24 is engaged with each of the cam pulleys 21A, 21B, 22A and 22B and one of the crank pulleys 23. A plurality of idlers are also provided on the side wall 10*a* of the engine body 10 to come into contact with an outer surface of the cogged endless belt 24. The cogged endless belt 24 thus engaged with the cam pulleys 21A, 21B, 22A and 22B and one of the crank pulleys 23 and having its outer surface in contact with the idlers is driven by the crank shaft 18 to run in a direction indicated with an arrow R for driving each of the camshafts 13, 14, 15 and 16 and this results in that the first and second cylinder banks 11 and 12 are disposed respectively on the tension and slack sides of the cogged endless belt 24.

Figure 3:
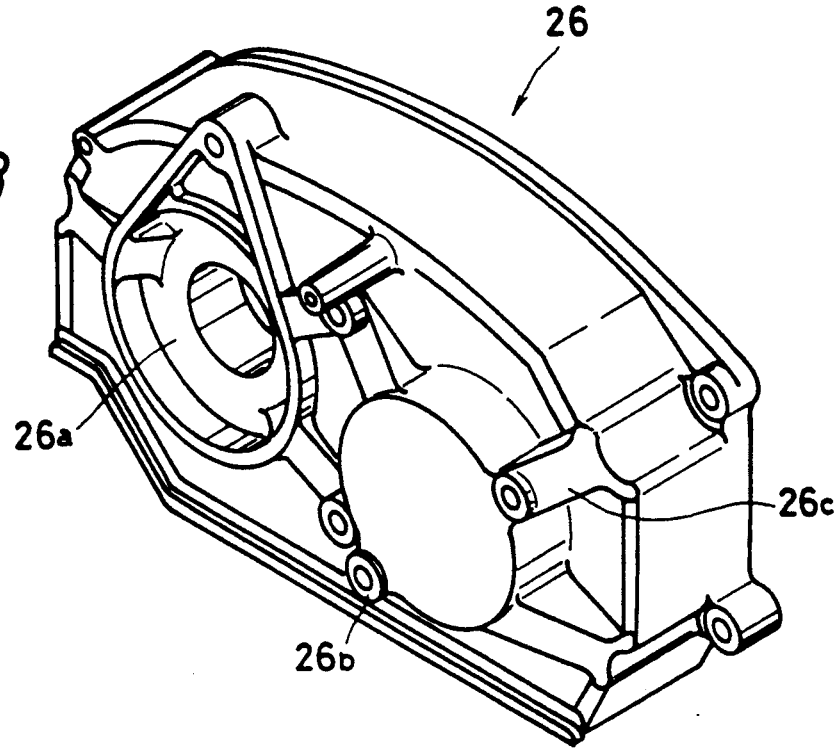
FIG. 3 is a schematic perspective view showing a belt cover attached to a cylinder bank in the embodiment shown in FIG. 1.

A belt cover 26 made of metal as shown in detail in FIG. 3 is attached with fastening bolts to an end portion of the cylinder head 7 on the side of the side wall 10*a* of the engine body 10 for covering the cam pulleys 21A and 22A and a part of the cogged endless belt 24. A case 25*b* of the distributor 25 is supported by a supporting recess 26*a* provided on the belt cover 26 so that the distributor 25 is improved in its rigidity. Further, a belt cover 27 is attached to an end portion of the cylinder block 6 forming the side wall 10*a* of the engine body 10 for covering one of the crank pulleys 23 with which the cogged endless belt 24 is engaged, the cam pulleys 21B and 22B and another part of the cogged endless belt 24.

Then, an engine-driven supercharger 30 is mounted through a supporting bracket 33 on the engine body 10 to jut out widthwise from the first cylinder bank 11 and to be positioned at substantially the same level as the distributor 25. A pulley 30*a* is mounted on a rotary shaft of the engine-driven supercharger 30 and an endless belt 32 is engaged with each of the pulley 30*a* and a crank pulley 31 which is the outermost one of the crank pulleys 23 and driven by the crank shaft 18 to run for driving the engine-driven supercharger 30. The supporting bracket 33 by which the engine-driven supercharger 30 is supported is attached with fastening bolts 28 to each of bosses 26*b* and 26*c* provided on the belt cover 26 as shown in FIG. 3 and a bracket 29 extending from the cylinder block 6 for supporting a pump 38 of an air conditioner. With the supporting bracket 33 thus fixed to the bosses 26*b* and 26*c* on the belt cover 26 made of metal, the engine-driven supercharger 30 is stably held.

The pump 38 of the air conditioner supported by the bracket 29 to be driven to rotate through an endless belt 38*a* by is disposed to jut out from the side wall 10*a* of the engine body 10 on the side of the first cylinder bank 11. In addition, each of an alternator 36 driven to rotate through an endless belt 36*a* by the crank shaft 18 and a pump 37 of a power steering device driven through an endless belt 37*a* by the crank shaft 18 is disposed to jut out from the side wall 10*a* of the engine body 10 on the side of the second cylinder bank 12. Further, a water pump 40 driven to rotate through the endless belt 36*a* by the crank shaft 18 in common with the alternator 36 is disposed on a central portion of the side wall 10*a* of the engine body 10.

Besides, parts and members forming intake and exhaust passages are disposed in a space between the first and second cylinder banks 11 and 12.

In the embodiment of V-type engine according to the present invention, since the valve timing controllers 20A and 20B are mounted respectively on the end portions of the camshafts 13 and 16 disposed for driving the exhaust valves in the first and second cylinder banks 11 and 12 for adjusting the closing timing of each of the exhaust valves provided in the first and second cylinder banks 11 and 12, knocking in each of the cylinders in the first and second cylinder banks 11 and 12 is effectively suppressed under a condition in which the engine-driven supercharger 30 operates to raise output power and to improve fuel consumption.

What is claimed is:

1. A V-type engine equipped with a supercharging device, the V-type engine comprising:

an engine body having first and second cylinder banks formed in the V-shape and a crank shaft disposed therein, wherein a lengthwise direction extends along the engine in a direction in which said cylinder banks extend and a widthwise direction extends transverse to the lengthwise direction, a pair of camshafts disposed in said first and second cylinder banks, respectively, an endless belt engaged with each of one end portions of the camshafts and one end portion of the crank shaft in such a manner that said first cylinder bank is disposed on a tension side of said endless belt wherein the tension side of the endless belt is upstream from the crank shaft and a slack side of the endless belt is downstream from the crank shaft with respect to a direction of movement of the endless belt, and an engine-driven supercharger mounted on the engine body to jut out widthwise from said first cylinder bank and driven to rotate by the crank shaft through an additional endless belt engaged with the engine-driven supercharger and said one end portion of the crank shaft thereby providing a widthwise mounting of the engine driven supercharger while preventing excessive leaning of the cylinder banks.

2. A V-type engine according to claim 1 further comprising a distributor provided on said first cylinder bank to be driven to rotate by the camshaft disposed in said first cylinder bank.

3. A V-type engine according to claim 2, wherein said distributor is mounted on one end portion of the camshaft disposed in said first cylinder bank.

4. A V-type engine equipped with a supercharging device, the V-type engine comprising;

an engine body having first and second cylinder banks formed in the V-shape and a crank shaft disposed therein wherein a lengthwise direction extends along the engine in a direction in which said cylinder banks extend and a widthwise direction extends transverse to the lengthwise direction, a first couple of camshafts disposed in said first cylinder bank for driving first intake valves and first exhaust valves, respectively, a second couple of camshafts disposed in said second cylinder bank for driving second intake valves and second exhaust valves, respectively, an endless belt engaged with each of one end portions of said first and second couples of camshafts and one end portion of the crank shaft in such a manner that said first cylinder bank is disposed on a tension side of said endless belt wherein the tension side of the endless belt is upstream from the crank shaft and a slack side of the endless belt is downstream from the crank shaft with respect to a direction of movement of the endless belt, and an engine-driven supercharger mounted on the engine body to jut out widthwise from said first cylinder bank and driven to rotate by the crank shaft through an additional endless belt engaged with the engine-driven supercharger and said one end portion of the crank shaft thereby providing a widthwise mounting of the engine driven supercharger while preventing excessive leaning of the cylinder banks.

5. A v-type engine according to claim 4 further comprising a distributor provided on said first cylinder bank to be driven to rotate by one of said first couple of camshafts driving the first intake valves.

6. A V-type engine according to claim 5, wherein said distributor is mounted on one end portion of said one of said first couple of camshafts driving the first intake valves.

7. A V-type engine according to claim 4 further comprising first and second timing control devices provided on said first and second cylinder banks to be engaged with one of said first couple of camshafts driving the first exhaust valves and one of said second couple of camshafts driving the second exhaust valves, respectively.

8. A V-type engine according to claim 7 further comprising a distributor provided on said first cylinder bank to be driven to rotate by the other of said first couple of camshafts driving the first intake valves.

9. A V-type engine according to claim 8, wherein said said first and second valve timing devices are mounted on one end portions of said one of said first couple of camshafts driving the first exhaust valves and of said one of said second couple of camshafts driving the second exhaust valves, respectively, and said distributor is mounted on one end portion of the other of said first couple of camshafts driving the first intake valves.

* * * * *